United States Patent [19]

Takeuchi et al.

[11] Patent Number: 4,676,189

[45] Date of Patent: Jun. 30, 1987

[54] ELECTROSTATIC SPRAY COATING APPARATUS

[75] Inventors: Hitoshi Takeuchi; Naoki Yamada; Hisao Ikemura; Noriyasu Suzuki, all of Toyota, Japan

[73] Assignees: Toyota Jidosha Kabushiki Kaisha, Toyota; Trinity Industrial Corporation, Tokyo, both of Japan

[21] Appl. No.: 801,856

[22] Filed: Nov. 26, 1985

[30] Foreign Application Priority Data

Nov. 26, 1984 [JP] Japan ..... 59-249194

[51] Int. Cl.[4] ..... B05B 5/04

[52] U.S. Cl. ..... 118/626; 118/326; 118/DIG. 7

[58] Field of Search ..... 118/326, 626, DIG. 7

[56] References Cited

U.S. PATENT DOCUMENTS

| | | | |
|---|---|---|---|
| 3,104,181 | 9/1963 | Minnick | 118/326 X |
| 3,482,545 | 12/1969 | Biddison | 118/326 X |
| 3,512,502 | 5/1970 | Drum | 118/626 |
| 4,089,295 | 5/1978 | Thomson et al. | 118/326 X |

*Primary Examiner*—Shrive P. Beck

*Attorney, Agent, or Firm*—Oblon, Fisher, Spivak, McClelland & Maier

[57] ABSTRACT

An electrostatic spray coating apparatus. Piping for supplying paint, operating air, etc. is divided in the middle of its course between a pressurized air source and downstream portions such as an air motor and a color-change valve, and is connected by a joint at these divided points. The apparatus can thereby be put to functional testing before it is installed on its work spot.

6 Claims, 3 Drawing Figures

ELECTROSTATIC SPRAY COATING APPARATUS

BACKGROUND OF THE INVENTION

1. Field of the Invention

The present invention relates to an attachment construction of a hosepipe of an electrostatic spray coating apparatus.

2. Description of the Prior Art

One example of the conventional electrostatic spray coating apparatus is a bell-type coating apparatus which is known such as having a bell cup attached to a power axle of an air motor fixed to one end of an insulating support, a color-change valve of paint is fixed in the vicinity of the air motor, and a color-change washing means forwardly moves a shroud in the case of the washing operation in the color changing process and backwardly moves the shroud in the case of the coating operation.

When a mini-bell coating apparatus which is an example of the apparatus of this type is set in its work location, first the mini-bell coating apparatus 1 is installed in a booth 10, and a motor for driving air supplies air to the air motor 3, as shown in FIG. 3, and piping work is utilized so that bearing air and shaping air are communicated from a pressurized air source 11 installed outside the booth 10 (on the right side of a booth wall 13 as viewed in FIG. 3) immediately to the air motor 3 through the booth wall 13. Similarly, operating air supplied to paint-color-change valves $V_1$, $V_2$, $V_3$ . . . disposed in the vicinity of the air motor 3 is communicated through piping from the pressurized air source 11 located outside the booth 10 immediately to the paint-color-change valves $V_1$, $V_2$, $V_3$ . . .

Thus constructing the conventional apparatus, the prior art has disadvantages as follows.

First, a high-priced hose made of teflon must be used as a member such as an operating air hose (indicated in FIG. 3 with a numeral 12) of the paint-color-change valve for the purpose of preventing a leak of electric current caused by condensation due to the high humidity atmosphere (i.e. humidity of 80% to 90%) in the booth. The longer the mini-bell coating apparatus and the pressure-air source are spaced apart, the longer the length of the teflon air hose becomes, thus heightening the material cost.

Secondly, relating to the problem above described, the mini-bell coating apparatus often causes problems such as malfunction when used for the first time after the piping is completed, because the apparatus cannot be functional tested until it is installed at its work location and the piping work completed.

Additionally, the piping work between the bell coating apparatus (the electrostatic spray coating apparatus) and the pressurized air source can not be carried out before the apparatus and the pressure-air source are installed together at the work location. Correspondingly, the term required for construction at the work location is prolonged.

SUMMARY OF THE INVENTION

For the purpose of solving the problems above described, the present invention provides a technical method characterized in that an air motor for atomizing a quantity of paint is mounted on one end of an insulating support, and, at the rear of an electrostatic spray coating apparatus having a paint-color-change valve in the vicinity of the end of the insulating support, that is, on the side of the other end of the insulating support, are mounted a plurality of joints which divide hoses into two portions and connect those two portions together, the divided portions of the air hoses connected to the air motor and to the paint-color-change valves being thereby interconnected.

Accordingly, the object of the present invention is to provide an attachment construction of hoses of the electrostatic spray coating apparatus.

DETAILED DESCRIPTION OF THE INVENTION

One embodiment of the present invention will be described hereinafter with reference to the accompanying figures.

Figure 1:
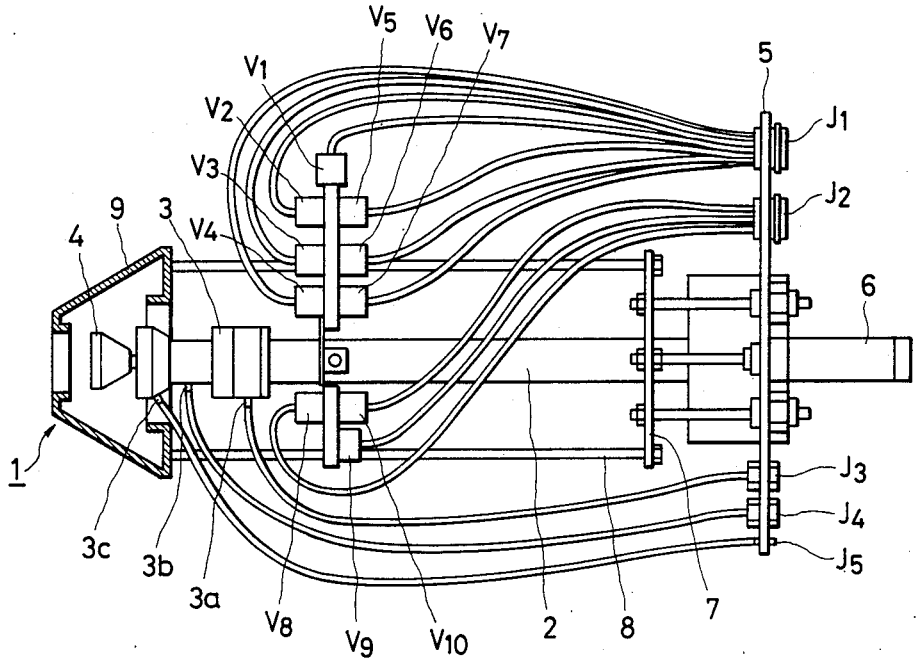
FIG. 1 is a plan view of one embodiment of the present invention.

FIG. 1 shows in plan a mini-bell coating apparatus 1 (an electrostatic spray coating apparatus) relating to the embodiment of the present invention. In this apparatus, an air motor 3 is fixed to one end of an insulating support 2, and a bell-cup 4 is attached to the power axle of the air motor 3. According to the present invention, the insulating support has electrical insulating properties for the purpose of preventing a leak and is arranged such that it supports on the side of one of its ends the electrostatic spray coating apparatus, and is provided at the other end with a supporting member which is attached to an automatic machine such as a robot.

Figure 3:
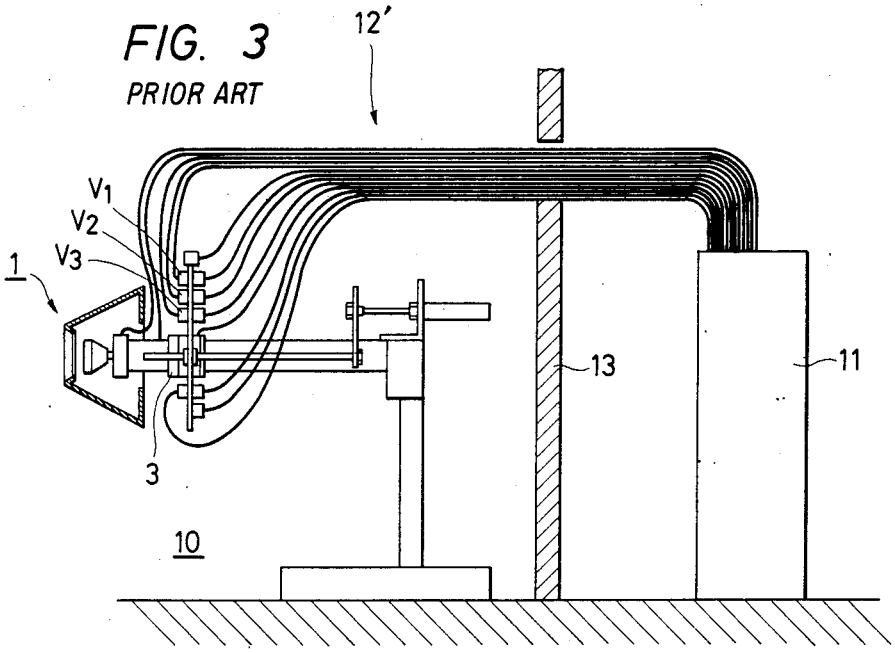
FIG. 3 PRIOR ART
FIG. 3 is a conventional mini-bell coating apparatus installed on its work spot.

A paint-color-change valve, a thinner valve and a washing air valve $V_1$, $V_2$, . . . , $V_9$, $V_{10}$ are secured in the vicinity of one end of the insulating support 2. At the outside of the bell-cup 4 is disposed a color-change washing means which is composed of an air cylinder 6 fixed to a plate 5 located at the other end of the insulating support 2, a plate 7 connected with the power axle of the air cylinder 6, a shroud guide 8 with its one end connected to the plate 7, and a shroud 9 connected to the other end of the shroud guide 8 and having an opening corresponding to the bell-cup 4, and in which, in the case of the washing operation in the color changing process, the shroud 9 moves forwards (i.e. leftward movement as viewed in FIG. 3) by virtue of the extending movement of the air cylinder 6 and by the medium of the plate 7 and the shroud guide 8, and, in the case of the coating process, the shroud 9 moves backwards by virtue of the contracting movement of the air cylinder 6 by the medium of the plate 7 and the shroud guide 8.

A plurality of hose relaying joints $J_1$, $J_2$, $J_3$, $J_4$, $J_5$ are fixedly attached to the upper portion of the plate 5, operating air hoses are connected to the color-change valves $V_1$, $V_2$, $V_3$, $V_4$, $V_5$, $V_6$, $V_7$ by way of the joint $J_1$, and other operating air hoses are connected to the color-change valves $V_8$, $V_9$, $V_{10}$ by way of the joint $J_2$. Other air hoses are respectively connected to a driving air inlet opening **3*a* of the driving motor 3, a bearing air inlet opening 3*b* and a shaping air inlet opening 3*c* of the driving motor 3 by way of the joints $J_3$, $J_4$ and $J_5$. The apparatus is so constructed that before the apparatus is installed on the work location the piping above described can be carried out by using the hose joints $J_1$, $J_2$, $J_3$, $J_4$, $J_5$ of the present invention, and teflon hoses need not necessarily be used as an anti-leak means except the portions where they are used between the paint-color-change valves $V_1$, $V_2$, . . . , $V_9$, $V_{10}$ and the joints $J_1$, $J_2$ and between the driving air inlet openings 3a, 3b, 3c** and the joints $J_3$, $J_4$, $J_5$.

Figure 2:
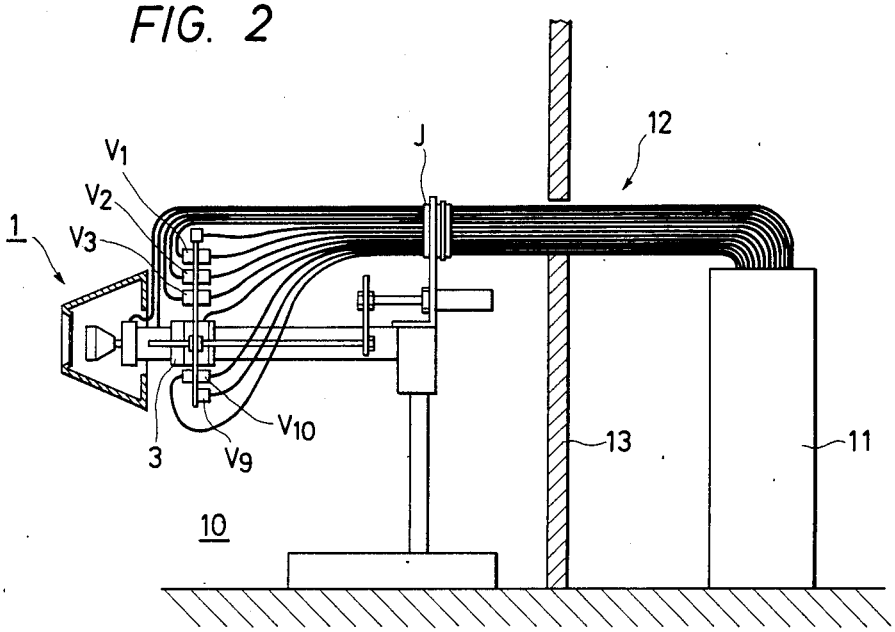
FIG. 2 is a diagram showing the entire apparatus of FIG. 1 installed on its work spot.

Next, the invention will be described in connection with its installation work at the work location. The piping between the color-change valves $V_1$, $V_2$, . . . $V_9$, $V_{10}$ and the joints $J_1$, $J_2$ and between the driving air inlet openings 3a, 3b, 3c and the joints $J_3$, $J_4$, $J_5$ should be completed in advance. The mini-bell coating apparatus 1 with this piping completed is brought and installed in a booth 10 at the work location, and one end of each air hose 12 is connected to a pressurized air source which is previously installed outside the booth 10, while the other end of the air hose 12 is connected to the hose joint (shown in the FIG. 2 by a reference character J) through the booth wall 13. As the installation work is completed by these processes alone, the process of conducting piping at the work location is not necessary.

It will be apparent that the present invention can be applied to a bell-type coating apparatus and a disc-type coating apparatus, as well as the mini-bell coating apparatus described above.

Thus, the air hoses are respectively connected to the air motor and the paint-color-change valves by way of the hose joints attached to the other end of the insulating support, so that the piping connected to the air motor and the paint-color-change valves can be provided even in the off-line period, functional testing of the rotatively spraying electrostatic coating apparatus thus being simultaneously possible. If it is necessary to prevent a leak caused by condensation occurring on the surface of the air hose, the teflon air hose may be used to provide communication between the hose joints and the air motor and the color-change valve and need not necessarily be used as a means of communication from the hose joints to the pressurized air source.

As described above, the present invention provides a constitution in which the joints for connecting the hoses to the air motor for atomizing a quantity of paint and to the paint-color-change valve are located on the side opposite to the side on which the air motor of the electrostatic spray coating apparatus and the paint-color-change valve are located and which is characterized as follows.

The conventional method has required the use of teflon hose for the purpose of preventing a leak which has needed to be disposed at a long distance from the pressurized air source to the motor and the valve, but the present invention enables the use of the teflon hose to be restricted to a short length running from the motor and the valve to the hose joints, which is advantageous in terms of material costs.

Relating to this advantage, it is possible for the electrostatic spray coating apparatus which has its piping work completed in off-line time, to have its function tested before it is brought to the work location so that any accident such as a malfunction which would otherwise occurs after the apparatus is brought to the work spot can be checked beforehand. Furthermore, the work of providing piping to the air motor and the paint-color-change valve can be carried out before the apparatus is installed at the work spot, so that the term of construction on the work spot may be greatly reduced as compared with the case of the conventional method.

Obviously, numerous modifications and variations of the present invention are possible in light of the above teachings. It is therefore to be understood that within the scope of the appended claims, the invention may be practiced otherwise than as specifically described herein.

What is claimed is:

1. An electrostatic spray coating apparatus, comprising:

an air-pressure source;

a coating booth of insulating material and having a wall;

a plurality of color-change valves;

an insulating support which includes a coating means positioned at one end thereof and connected to said plurality of color-change valves;

piping means connected to said color-change valves for supplying paint and operating air and which passes through said wall of said coating booth and communicates with said air-pressure source; and a plurality of joints disposed integrally with said insulating support in said booth and connected by said piping means with said plurality of color-change valves wherein said plurality of color-change valves are secured in the vicinity of said one end of said insulating support and are connected by said piping means with said air-pressure source.

2. An electrostatic spray coating apparatus according to claim 1, wherein said electrostatic spray coating apparatus is a bell-type.

3. An electrostatic spray coating apparatus according to claim 1, wherein said electrostatic spray coating apparatus is of a mini-bell type.

4. An electrostatic spray coating apparatus according to claim 1, wherein said electrostatic spray coating apparatus is of a disc-type.

5. An electrostatic spray coating apparatus according to either claim 2 or claim 3, further comprising a washing shroud.

6. An electrostatic spray coating apparatus according to claim 1, wherein the piping means between said joint and a downstream portion comprises a teflon hose.

* * * * *